United States Patent [19]

Bell

[11] 4,353,138

[45] Oct. 12, 1982

[54] TWO STAGE FLUSH VALVE ASSEMBLY

[75] Inventor: Ralph M. Bell, Bradenton, Fla.

[73] Assignee: Bell and Rodhouse Engineering, Inc., Bradenton, Fla.

[21] Appl. No.: 295,080

[22] Filed: Aug. 21, 1981

[51] Int. Cl.[3] ..... E03D 1/34

[52] U.S. Cl. ..... 4/326

[58] Field of Search ..... 4/324, 326, 327, 411–414

[56] References Cited

U.S. PATENT DOCUMENTS

| | | | |
|---|---|---|---|
| 3,768,103 | 10/1973 | Robinson | 4/326 |
| 3,913,149 | 10/1975 | Brinton | 4/326 |
| 4,003,097 | 1/1977 | Book | 4/67 |
| 4,042,982 | 8/1977 | Contreras | 4/67 |
| 4,056,856 | 11/1977 | Reid | 4/67 |
| 4,096,591 | 7/1978 | Awis | 4/326 |
| 4,110,850 | 9/1978 | Tedei | 4/326 |
| 4,122,564 | 10/1978 | Addicks et al. | 4/326 |
| 4,172,299 | 10/1979 | del Pozo | 4/326 |
| 4,173,801 | 11/1979 | Bresnyan | 4/326 |

*Primary Examiner*—Charles E. Phillips

*Attorney, Agent, or Firm*—Benjamin P. Reese, II

[57] ABSTRACT

A two level flush valve assembly for use in a water tank of a conventional toilet. An essentially cylindrical, hollow valve body has an upper flush opening, a lower flush opening, an overflow pipe and a discharge opening. The valve body is positioned in the interior of a toilet water tank with its lower end extending downward through an opening in the bottom of the tank. An extension arm is fastened to the free end of the lever arm which is operated by the flush handle of the toilet. A pulley is rotatably mounted on the free end of the extension arm and operatively engaged by a chain which interconnects a pair of valve elements pivotedly connected to the valve body for closing the upper flush opening and the lower flush opening. The valve element which closes the upper flush opening is pivoted open by the pulley and chain mechanism in response to movement of the flush handle, lever arm and extension arm for approximately one-half of their total distance of travel. Movement of the flush handle, lever arm and extension arm for their total distance of travel pivots both of the valve elements open.

7 Claims, 3 Drawing Figures

TWO STAGE FLUSH VALVE ASSEMBLY

BACKGROUND OF THE INVENTION

This invention relates to a new and improved two level flush valve assembly for use in the water tank of a conventional toilet.

It has become more and more apparent in recent years that our nation's water resources are not as plentiful as they were once believed to be. Systematic efforts to conserve water are essential for the general welfare of our nation and its inhabitants. In this regard, it is well known that the conventional toilet consumes large volumes of water for flushing operations. Yet, only relatively small volumes of water are actually required for the most frequently occurring flushing operations, i.e. those which dispose of liquid wastes only. Accordingly, it is desirable to have an efficient means for partially flushing a conventional toilet to dispose of liquid wastes and totally flushing the same toilet to dispose of solid wastes.

Various means, including two level flush valve assemblies, for selectively partially and totally flushing a conventional toilet are well known in the art. Various two level flush valve assemblies, several of which are structurally similar to the present invention, are disclosed in U.S. Pat. Nos. 4,003,097; 4,042,982; 4,056,856; 4,096,591; 4,110,850; 4,172,299; and 4,173,801. Unfortunately, the two level flush valve assemblies disclosed in these patents have relatively complex operative mechanisms and are relatively expensive to manufacture. Most are difficult to install in the water tank of a conventional toilet. Many are so difficult to install that the services of a professional plumber would be required by the majority of homeowners desiring installation.

It would be advantageous to have a two level flush valve assembly having a simple operative mechanism which is suitable for use with the existing flush handle and lever arm of a conventional toilet. Preferably, such a flush valve assembly should be inexpensive to manufacture and easy to install. It is believed that a two level flush valve assembly having such advantageous features would be an efficient means for partially flushing the toilet when it is necessary to dispose of liquid wastes and totally flushing the toilet when it is necessary to dispose of solid wastes. And, of course, if a substantial number of homeowners accept and use such a flush valve assembly, the end result would be a substantial conservation of our nation's increasingly scarce water resources.

SUMMARY OF THE INVENTION

The present invention provides a new and improved two level flush valve assembly for use in the water tank of a conventional toilet.

The flush valve assembly of the present invention comprises an essentially cylindrical, hollow valve body having an upper flush opening, a lower flush opening, an overflow pipe and a discharge opening. A pivotedly connected upper valve element and a pivotedly connected lower valve element are provided for closing the upper flush opening and the lower flush opening, respectively, between flushes. The valve body is positioned in the interior of a conventional toilet water tank with its lower or discharge end positioned in and through the discharge opening in the bottom of the water tank. An extension arm having a pulley rotatably mounted thereon is fastened to the free end of the existing flush handle operated lever arm in the toilet tank. A chain engages the grooved rim of the pulley and interconnects the upper valve element and the lower valve element.

The toilet is partially flushed by moving the flush handle approximately one-half of its total distance of travel. This moves the lever arm and extension arm upward for approximately one-half of their total distance of travel, and, acting through the pulley, pulls the upper end of the chain to pivot the upper valve element open. Water in the toilet tank above the level of the upper flush opening enters the upper flush opening and flows downward through the valve body for subsequent discharge, through the discharge opening, into the toilet bowl. In this manner, a reduced, but sufficient, volume of water for flushing liquid wastes is permitted to enter the toilet bowl.

The toilet is totally flushed by moving the flush handle its total distance of travel. This moves the lever arm and extension arm upward for their total distance of travel, and, acting through the pulley, pulls both the upper end and the lower end of the chain to pivot both the upper valve element and the lower valve element open. Water in the toilet tank then enters both the upper flush opening and the lower flush opening and flows downward through the valve body for subsequent discharge, through the discharge opening, into the toilet bowl. In this manner, essentially the entire volume of water in the toilet tank is permitted to enter the toilet bowl for flushing solid wastes.

The two level flush valve assembly of the present invention is relatively inexpensive to manufacture and easy to install when compared to prior art flush valve assemblies. It will be readily appreciated by those skilled in the art that the operative mechanism of the flush valve assembly of the present invention is exceedingly simple when compared to the operative mechanisms used with prior art flush valve assemblies. Finally, the two level flush valve of the present invention is suitable for use with the existing flush handle and lever arm of most conventional toilets.

These and many other features and advantages of the present invention will be apparent from the following brief description of drawings, detailed description of the preferred embodiment and claims, and the accompanying drawings.

DETAILED DESCRIPTION OF THE PREFERRED EMBODIMENT

Figure 1:
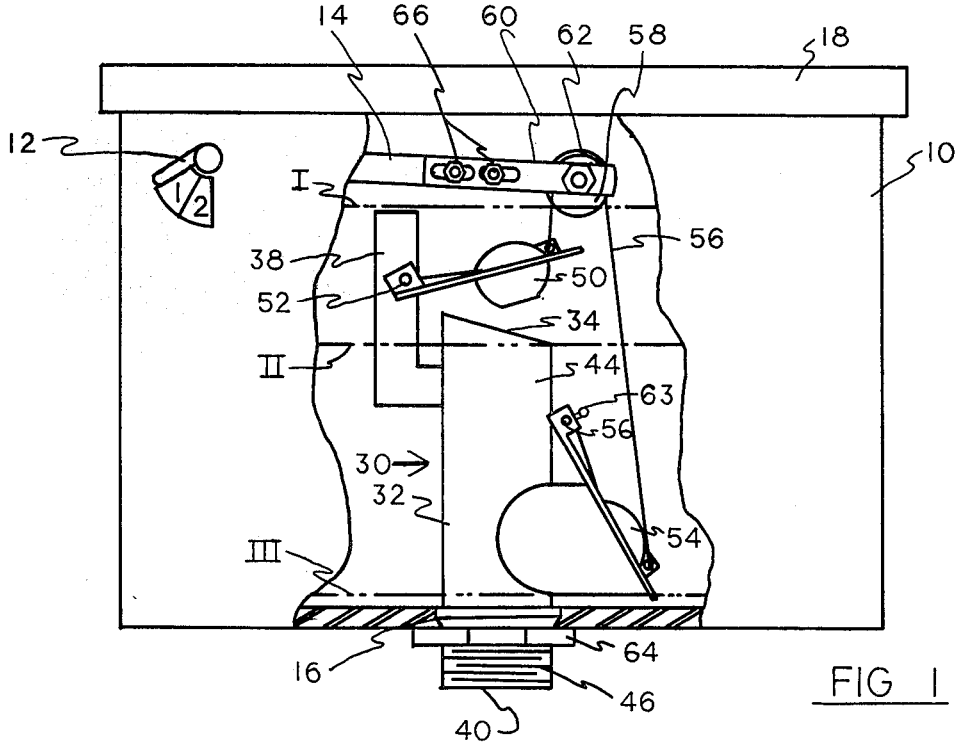
FIG. 1 is a front elevational view, partially cut-away and in section, of a conventional toilet water tank including a two level flush valve assembly embodying concepts of the present invention. The flush valve assembly is illustrated with its upper valve element open for a partial flush to dispose of liquid wastes.
Figure 2:
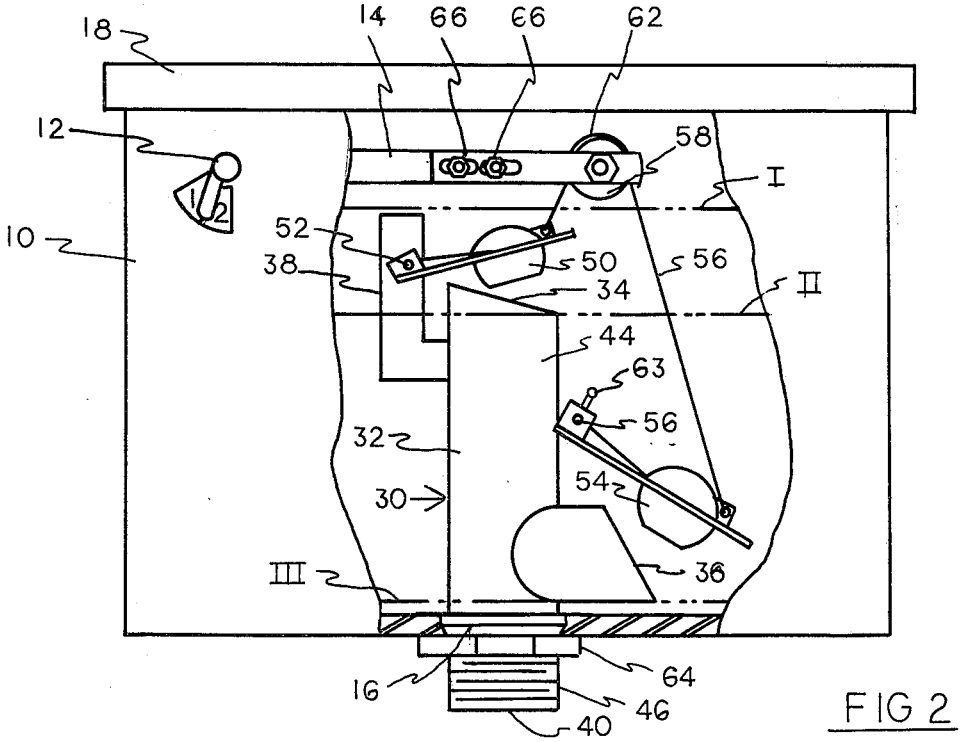
FIG. 2 is a front elevational view similar to FIG. 1, but illustrating the flush valve assembly with both of its valve elements open for a total flush to dispose of solid wastes.
Figure 3:
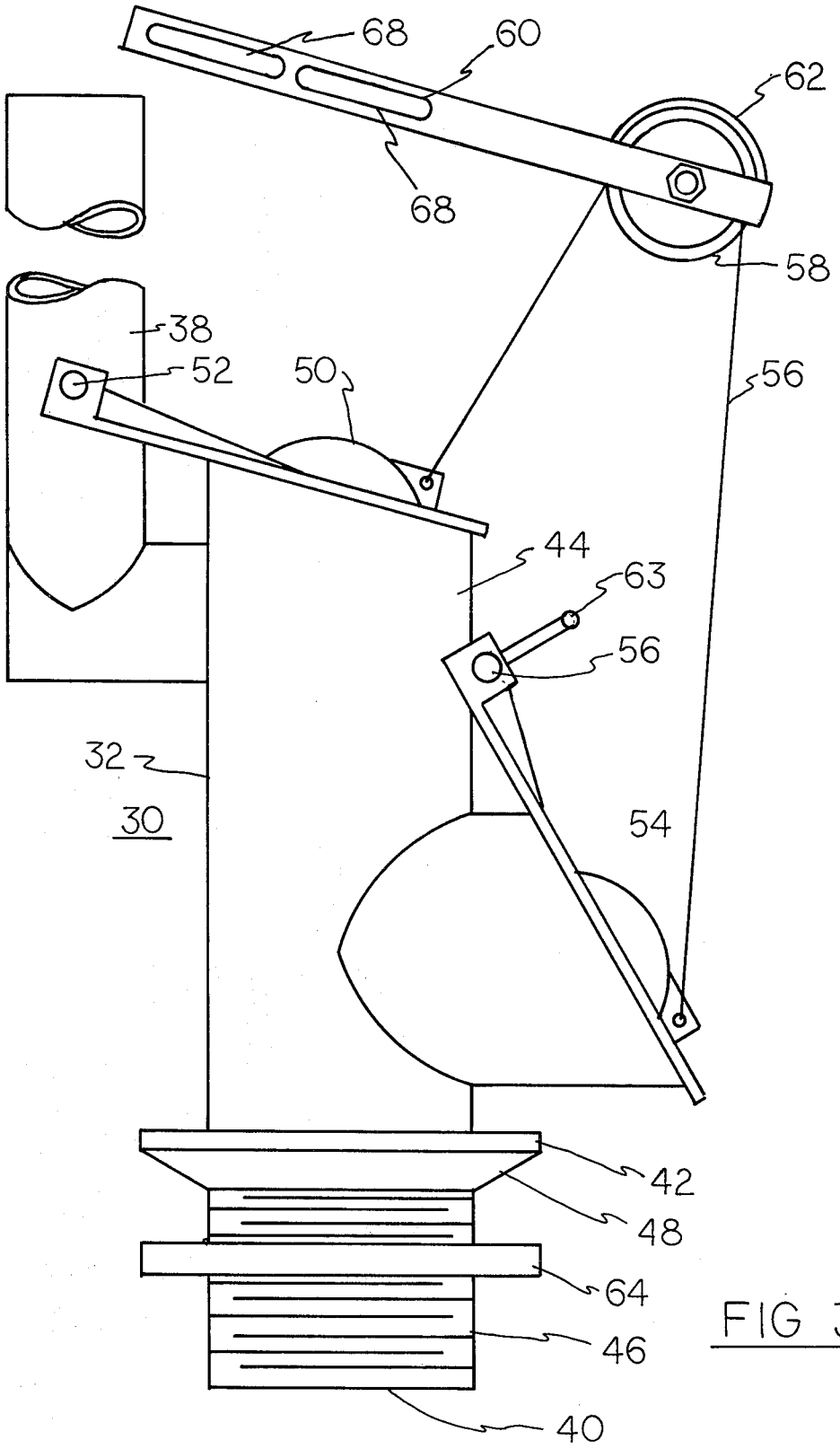
FIG. 3 is a detailed front elevational view of the two level flush valve assembly illustrated in FIGS. 1 and 2.

The structure and use environment of the preferred embodiment of the two level flush valve of the present invention are illustrated in FIGS. 1, 2 and 3.

Referring to FIGS. 1 and 2, a conventional toilet water tank 10 is illustrated. The water tank 10 which is illustrated has a flush handle 12, a lever arm 14, a discharge opening 16 and a removable top 18. The water tank 10 is mounted over an upper opening near the back of a conventional toilet bowl (not illustrated) in the well known manner. Water is supplied to the water tank 10 through a conventional water input line and valve combination (not illustrated) which controls the water level in the water tank 10 during normal operation. If the conventional water input line and valve combination is functioning properly, the water level in the water tank 10 will be maintained slightly below level I at equilibrium between flushes.

A two level flush valve assembly 30 is positioned in the interior of the water tank 10. Referring to FIG. 3, an enlarged detail view of the flush valve assembly 30 is presented to assist the reader in obtaining a better understanding of its structure. The flush valve assembly 30 comprises an essentially cylindrical, hollow valve body 32 having an upper flush opening 34, a lower flush opening 36, an overflow pipe 38 and a discharge opening 40. A flange 42 separates the upper or intake end 44 and the lower or discharge end 46 of the valve body 32. The lower or discharge end 46 is threaded and a wedge-shaped rubber gasket 48 is fitted over that end and positioned immediately below the flange 42. Preferably, the valve body 32 is formed as a one-piece molded PVC or other suitable plastic body.

A first or upper valve element 50 is pivotedly connected to projecting ears 52 on the overflow pipe 38 and a second or lower valve element 54 is pivotedly connected to projecting ears 56 on the upper or intake end 44 of the valve body 32. The upper valve element 50 and the lower valve element 54 are provided for closing the upper flush opening 34 and the lower flush opening 36, respectively, between toilet flushes. Accordingly, it is preferable that both the upper valve element 50 and the lower valve element 54 be of the well known soft rubber type which are commercially available. The upper valve element 50 and the lower valve element 54 are interconnected by a chain 56 which engages the grooved rim of a pulley 58 rotably mounted on one end of an extension arm 60. A cover 62 is positioned above the pulley 58 to prevent the chain 56 from disengaging the grooved rim during flushing operations. And, a stop 63 is positioned above the projecting ears 56 for limiting the upward movement of the lower valve element 59 during flushing operations.

Returning to FIGS. 1 and 2, it will be seen that the lower or discharge end 46 of the valve body 32 is positioned in and extends downward through the discharge opening 16 in the bottom of the water tank 10. The gasket 48 is shaped to conform to the shape of the discharge opening 16. A conventional nut 64 engages the threaded lower or discharge end 46, and, when tightened against the bottom of the water tank 10, maintains the valve body in position and compresses the gasket 48 to form a seal which prevents leakage of water around the valve body 32 to the toilet bowl below. Preferably, the nut 64 is formed from a hard nylon or other suitable corrosion resistant material.

The extension arm 60 is rigidly fastened to the free end of the lever arm 14 by conventional means, such as a pair of nuts and bolts 66 which pass through alined holes in the extension arm 60 and lever arm 14. Preferably, as best seen in FIG. 3, the holes 68 in the extension arm 60 are elongated such that the extension arm 60 is adaptable for use with existing lever arms having different lengths and different hole locations. In this manner, it is possible to easily install the two level flush valve assembly 30 without modifications to the existing flush handle 12 and lever arm 14.

Having described the structure of the two level flush valve assembly, its operation and use will now be described. When it is desired to partially flush the toilet to dispose of liquid wastes only, the flush handle 12 on the exterior of the water tank 19 is moved to Position 1. In response to this movement of the flush handle 12, the lever arm 14 and extension arm 60 move upward for approximately one-half of their total distance of travel and impart force to the pulley 58. The pulley 58 rotates in a clockwise direction, and, thereby, pulls the upper end of the chain 56 upward at an angle which creates a mechanical advantage of approximately two to one such that the chain 56 moves approximately two inches for every one inch of upward movement of the lever arm 14, extension arm 60 and pulley 58. The upward force which the chain 56 exerts on the upper valve element 50 overcomes the downward force which is exerted on said valve element by the water in the water tank 10 and the upper valve element 50 pivots open to permit water to enter the upper flush opening 34 of the valve body 32 and flow downward through the valve body 32 for subsequent discharge through the discharge opening 40 into the toilet bowl below. It will be readily appreciated that the downward force which is exerted on the upper valve element 50 by the water in the water tank 10 is substantially less than the downward force which is exerted on the lower valve element 54 by said water and that this force differential is necessary to permit the upper valve element 50 to pivot open while the lower valve element 54 is maintained in a closed mode.

The water consumed by the partial flush described above corresponds to the volume of water contained between Level I and Level II of the water tank 10. When it is desired to totally flush the toilet to dispose of solid wastes, i.e. to flush the toilet with the volume of water contained between Level I and Level III of the water tank, the flush handle 12 on the exterior of the water tank 10 is moved to Position 2. In response to this movement of the flush handle 12, the lever arm 14 and an extension arm 60 move upward for their total distance of travel and impart force to the pulley 58. As the lever arm 14, extension arm 60 and pulley 58 move upward, the pulley 54 first rotates in a clockwise direction pulling the upper end of the chain 56 upward in the manner described above pivoting the upper valve element 50 open to permit water to enter the upper flush opening 34 of the valve body 32. As the water flows downward through the valve body 32, the downward force which is exerted on the lower valve element 54 is reduced and the pulley 48 then rotates in a counterclockwise direction, and, thereby, pulls the lower end of the chain 56 upward at an angle which creates a mechanical advantage of approximately two to one as described above. The upward force which the chain 56 exerts on the lower valve element 54 overcomes the reduced downward force which is exerted on said valve element by the water in the water tank 10 and the lower valve element 54 then pivots open to permit water to enter the lower flush opening 36 of the valve body 32. In this manner, water enters both the upper flush opening 34 and the lower flush opening 36 of the valve body 32 and flows downward through the valve body 32 for subsequent discharge through the discharge opening 40 into the toilet bowl below.

The person flushing the toilet will feel an increased resistance to movement of the flush handle 12 as the flush handle 12 is moved from Position 1 to Position 2. Inasmuch as this increased resistance is felt after the upper valve element 50 has pivoted open but before the lower valve element 54 is pivoted open, only minimal manual skill is necessary for a person to partially flush the toilet when only a partial flush is desired and to totally flush the toilet when a total flush is desired. It is believed that homeowners will readily accept and use the flush valve assembly 30 because of this relatively simple and foolproof method of operation and use.

While the present invention has been disclosed in connection with its preferred embodiment, it should be understood that there may be other embodiments which fall within the spirit and scope of the invention as defined by the claims.

I claim:

1. A two level flush valve assembly for use in a water tank of a toilet, comprising:

(a) an essentially cylindrical, hollow valve body having an upper flush opening, a lower flush opening, an overflow pipe and a discharge opening;

(b) a first valve element pivotedly connected to said valve body for closing said upper flush opening;

(c) a second valve element pivotedly connected to said valve body for closing said lower flush opening;

(d) a pivoted flush handle mounted on said tank, said handle having one end of a lever arm attached thereto;

(e) an extension arm for attachment to the other end of said lever arm;

(f) a pulley rotatably mounted on said extension arm; and (g) a chain which is entrained over said pulley and interconnects said first valve element and said second valve element such that only said first valve element is pivoted open in response to movement of said flush handle approximately one-half of its total distance of travel and both said first valve element and said second valve element are pivoted open in response to movement of said flush handle its total distance of travel.

2. A two level flush valve assembly as recited in claim 1, further comprising a stop for limiting the movement of said second valve element when said second valve element is pivoted open in response to movement of said flush handle its total distance of travel.

3. A two level flush valve assembly as recited in claim 1, further comprising a cover positioned above said pulley to prevent said chain from disengaging said pulley during flushing operations.

4. A two level flush valve assembly as recited in claim 1, wherein said extension arm has a pair of elongated holes for receipt of fastening bolts such that said extension arm is adaptable for use with toilet lever arms having different lengths and different fastening hole locations.

5. A two level flush valve assembly for use in a water tank of a toilet, comprising:

(a) an essentially cylindrical, hollow valve body having an upper flush opening, a lower flush opening, an overflow pipe and a discharge opening;

(b) a first valve element pivotedly connected to said valve body for closing said upper flush opening;

(c) a second valve element pivotedly connected to said valve body for closing said lower flush opening;

(d) a pivotal flush handle mounted on said tank, said handle having one end of a lever arm attached thereto;

(e) a pully rotatably mounted on the other end of said lever arm; and (f) a chain which is entrained over said pulley and interconnects said first valve element and said second valve element such that only said first valve element is pivoted open in response to movement of said flush handle approximately one-half of its total distance of travel and both said first valve element and said second valve element are pivoted open in response to movement of said flush handle its total distance of travel.

6. A two level flush valve assembly as recited in claim 5, further comprising a stop for limiting the movement of said second valve element when said second valve element is pivoted open in response to movement of said flush handle its total distance of travel.

7. A two level flush valve assembly as recited in claim 5, further comprising a cover positioned above said pulley to prevent said chain from disengaging said pulley during flushing operations.

* * * * *